US011177103B2

(12) United States Patent
Smith et al.

(10) Patent No.: US 11,177,103 B2
(45) Date of Patent: Nov. 16, 2021

(54) FUSE LINK EXHAUST SYSTEMS AND METHODS

(71) Applicant: S&C Electric Company, Chicago, IL (US)

(72) Inventors: Richard G. Smith, North Aurora, IL (US); Glenn R. Borchardt, Chicago, IL (US)

(73) Assignee: S&C Electric Company, Chicago, IL (US)

( * ) Notice: Subject to any disclaimer, the term of this patent is extended or adjusted under 35 U.S.C. 154(b) by 200 days.

(21) Appl. No.: 15/605,356

(22) Filed: May 25, 2017

(65) Prior Publication Data

US 2017/0345606 A1 Nov. 30, 2017

Related U.S. Application Data

(60) Provisional application No. 62/341,194, filed on May 25, 2016.

(51) Int. Cl.

| | |
|---|---|
| ***H01H 85/43*** | (2006.01) |
| ***H01H 85/175*** | (2006.01) |
| ***H01H 85/20*** | (2006.01) |
| ***H01H 31/12*** | (2006.01) |

(52) U.S. Cl.
CPC ..... *H01H 85/43* (2013.01); *H01H 31/127* (2013.01)

(58) Field of Classification Search
CPC .. H01H 85/43; H01H 85/175; H01H 85/2045; H01H 31/127; H01H 9/047; H01H 2213/00; H01H 2213/006; H01H 2227/02; H01H 45/12
USPC ..... 337/168, 171, 172, 174, 175, 176, 203, 337/222
See application file for complete search history.

(56) References Cited

U.S. PATENT DOCUMENTS 4,857,879 A * 8/1989 Morgan ..... H01H 31/127 337/168
5,289,154 A * 2/1994 Davis ..... H01H 85/42 337/169
5,502,427 A * 3/1996 Scherer ..... H01H 31/127 337/159

(Continued)

OTHER PUBLICATIONS

S&C SMD-20 Power Fuses, Outdoor Distribution (14.4kV through 34.5 kV), Descriptive Bulletin 242-32, Oct. 21, 2013, Offices Worldwide.

(Continued)

*Primary Examiner* — Stephen S Sul

(57) ABSTRACT

A power fuse assembly includes a fuse mounting, a fuse unit, and a hinge assembly. The fuse unit is configured to carry current from a line connection to a load connection. The hinge assembly is configured to be removeably coupled to the fuse unit and to allow rotation of the fuse unit relative to the fuse mounting. The hinge assembly including: an inlet configured to accept incoming gases produced by the fuse unit in response to an overload event, the inlet having a first orientation; an outlet in fluid communication with the inlet, the outlet having a second orientation that is not equal to the first orientation; and a diverter component disposed between the inlet and the outlet, the diverter configured to guide the flow of the gases between the inlet and the outlet.

8 Claims, 5 Drawing Sheets

(56) References Cited

U.S. PATENT DOCUMENTS

| | | | | |
|---|---|---|---|---|
| 5,773,777 | A * | 6/1998 | Scherer | H01H 85/0208 218/1 |
| 6,942,025 | B2 * | 9/2005 | Nair | F28F 3/04 165/185 |
| 6,955,215 | B2 * | 10/2005 | Al-Garni | F28D 21/00 165/185 |
| 2006/0044740 | A1 * | 3/2006 | Borchardt | H01H 85/43 361/626 |
| 2010/0139306 | A1 * | 6/2010 | Krenik | F25B 9/004 62/402 |
| 2011/0291793 | A1 * | 12/2011 | Favreau | H01H 31/127 337/171 |
| 2014/0151010 | A1 * | 6/2014 | Nichols | F28F 3/02 165/185 |
| 2015/0260155 | A1 * | 9/2015 | Ridings | F03D 1/0625 415/1 |
| 2016/0211620 | A1 * | 7/2016 | Sharf | H01R 12/724 |
| 2017/0102147 | A1 * | 4/2017 | Wang | F02C 3/04 |

OTHER PUBLICATIONS

S&C Power Fuses Types SM-4, SM-5, SMD-20, and SMD-40, Outdoor Distribution (4.16kV through 34.5 kV), Specification Bulletin 242-31, Oct. 4, 2010.

* cited by examiner

FUSE LINK EXHAUST SYSTEMS AND METHODS

CROSS-REFERENCE TO RELATED APPLICATIONS

This application claims the benefit of U.S. Provisional Application No. 62/341,194 filed on May 25, 2016, the entire disclosure of which is incorporated herein by reference.

TECHNICAL FIELD

The technical field generally relates to interrupting equipment in power distribution systems, and more particularly relates to fuse mountings used in connection with such systems.

BACKGROUND

Power distribution systems include a variety of subsystems designed to protect transformers and other components from overload conditions and current surges. One such system is the power fuse assembly or fuse cut-out, which is a protection device that is part fuse, part switch, and which is often used in connection with overhead feeder lines.

A power fuse assembly generally includes a fuse mounting that supports a fuse unit and associated fittings, all of which are rotatably coupled to the fuse mounting via a hinge assembly at its lower end. The fuse unit includes a fusible element that, during an overload event, deteriorates and then mechanically separates, causing the fuse unit to disconnect the electrical circuit by dropping the top end of the fuse unit out of the fuse mounting in a rotational manner. Deterioration of the fusible element during an overload event produces a significant amount of exhaust gases, which in some cases may be captured by a silencer assembly mounted to the bottom of the fuse cut-out. These exhaust gases may be on the order of many thousands of degrees Fahrenheit and exhibit a velocity on the order of the speed of sound.

Currently known exhaust systems for power fuse assemblies may be unsatisfactory in a number of respects. For example, such systems may not divert the exhaust in a desirable direction—e.g., away from a linemen or other individual in the vicinity of the power fuse assembly. Diversion of such gases is known to be difficult, since it is important to reduce any pressure drops that might arise in the path of the exhaust gases. Furthermore, currently known silencer assemblies may be too large to swing freely through the normal hinge assembly.

Accordingly, there is a need for accommodating the exhaust produced by fuse units of the type used in conjunction with power fuse assemblies. Other desirable features and characteristics of the present invention will become apparent from the subsequent detailed description and the appended claims, taken in conjunction with the accompanying drawings and the foregoing technical field and background.

DESCRIPTION OF THE DRAWINGS

The exemplary embodiments will hereinafter be described in conjunction with the following drawing figures, wherein like numerals denote like elements, and wherein.

DETAILED DESCRIPTION

A power fuse assembly in accordance with one embodiment includes a fuse mounting, a fuse unit, and a hinge assembly. The fuse unit is configured to carry current from a line connection to a load connection. The hinge assembly is configured to be removeably coupled to the fuse unit and to allow rotation of the fuse unit relative to the fuse mounting. The hinge assembly includes an inlet having a first orientation and configured to accept incoming gases produced by the fuse unit in response to an overload event. The hinge assembly also includes an outlet in fluid communication with the inlet and having a second orientation that is not equal to the first orientation. A diverter component is disposed between the inlet and the outlet and configured to guide the flow of gases from the inlet in the first orientation and to the outlet in the second orientation.

A hinge assembly in accordance with one embodiment is configured to be removeably coupled to a fuse unit of a power fuse assembly. The hinge assembly includes an inlet having a first orientation and configured to accept incoming gases produced by the fuse unit in response to an overload event. The hinge assembly also includes an outlet in fluid communication with the inlet and having a second orientation that is not equal to the first orientation. A diverter component is disposed between the inlet and the outlet and configured to guide the flow of gases from the inlet in the first orientation and to the outlet in the second orientation.

Figure 1:
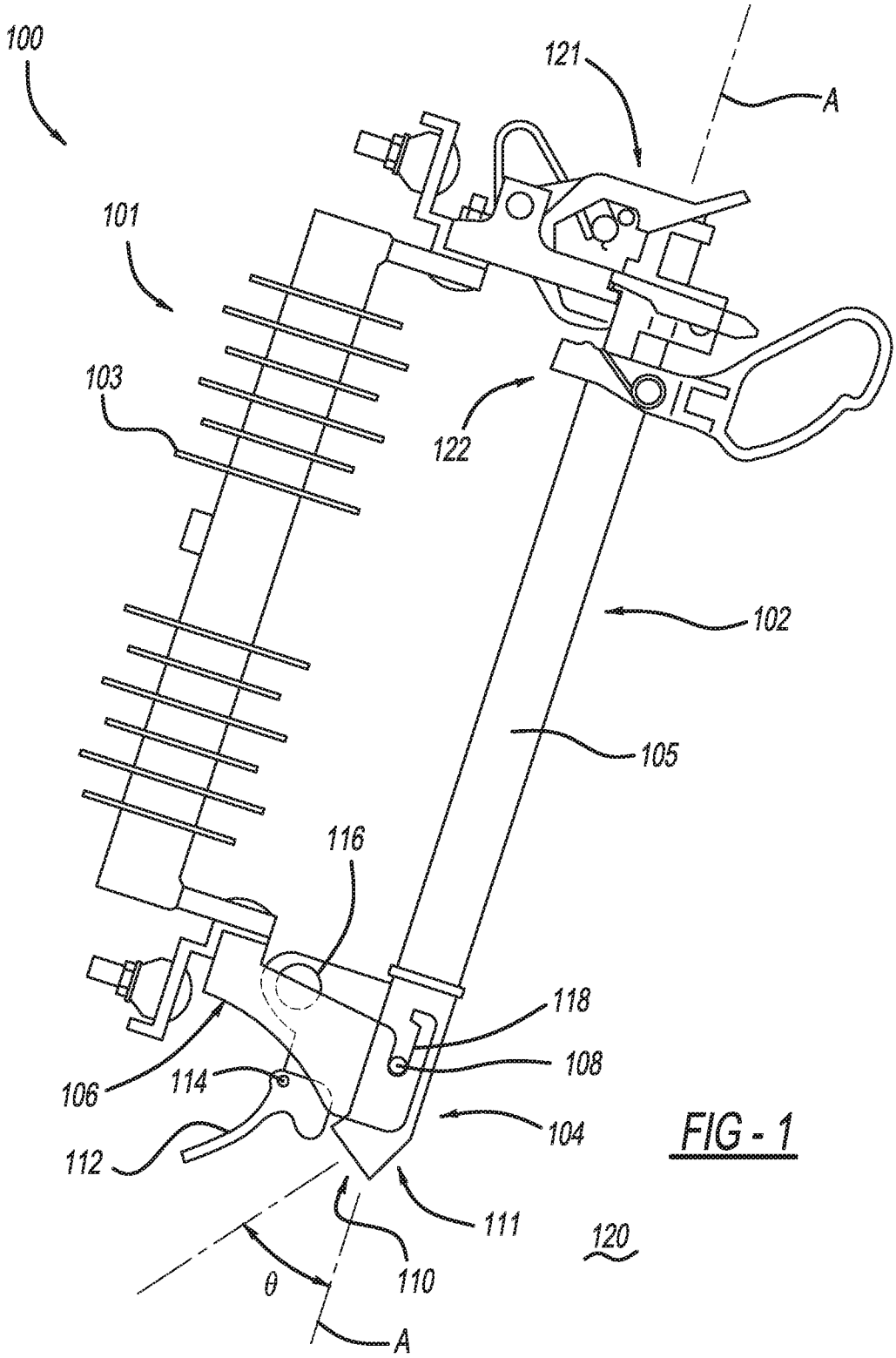
FIG. 1 is an exterior view of a power fuse assembly including a fuse mounting in accordance with one embodiment.
Figure 2:
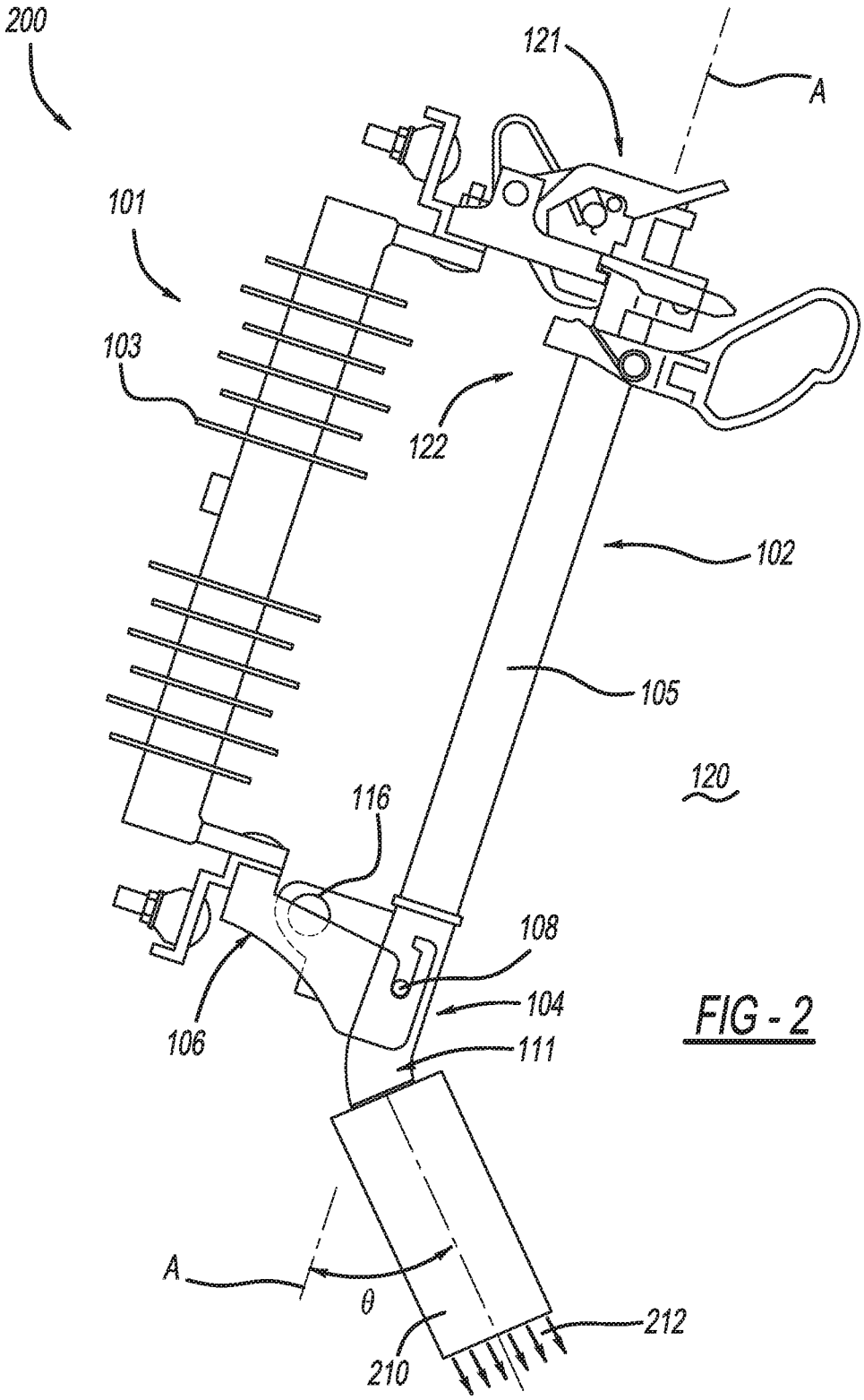
FIG. 2 is an exterior side view of a power fuse assembly including a fuse mounting in accordance with another embodiment.

FIGS. 1 and 2 are exterior side views of exemplary power fuse assemblies (or simply "assemblies") in accordance with various embodiments. Referring first to FIG. 1, power fuse assembly 100 includes a generally "C"-shaped fuse mounting 101 and a fuse unit 102 rotatably coupled to fuse mounting 101. Fuse unit 102 includes a fuse tube 105 defining a longitudinal axis A-A, as shown. Fuse mounting 101 includes an insulator or "body" 103, an upper contact assembly 121, and a lower contact assembly 106. Fuse mounting 101 also includes an upper end fitting 122 and a lower end fitting (also referred to as a "hinge assembly" herein) 104 coupled to opposite ends of the fuse tube 105 as shown. Hinge assembly 104 is rotatably (and removably) coupled to lower contact assembly 106 via a hinge pivot 108 that is received within a suitably dimensioned slot 118.

The upper end fitting 122 is mechanically and electrically coupled (e.g., via an interference fit or latch) to upper contact assembly 121 as shown. In overhead applications, fuse mounting 101 is generally mounted at a slightly forward-tipping angle (e.g., about 20-degrees) such that longitudinal axis A-A is not strictly normal to the plane of the ground or other substrate below fuse mounting 101. In that regard, front region 120 as well as the space below front region 120 may together be referred to herein as the space in "front" of fuse mounting 101 during normal operation, a location that an operator may in part occupy during maintenance or installation of fuse mounting 101 and/or fuse unit 102.

During an overload event, a fusible element (not shown) within the fuse tube 105 separates and fuse unit 102 is released (rotationally with respect to hinge pivot 108) out of fuse mounting 101 and toward front region 120, thereby creating an open circuit and providing a visual cue (via hanging fuse unit 102) that power fuse assembly 100 has experienced a fault condition.

The nature and operation of conventional fuse mountings, fuse elements, cut-outs, and the like, are known in the art, and need not be further described herein. In that regard, the subject matter described herein may be used in a wide variety of power fuse assemblies. One such assembly, for example, is the SMD-20 Power Fuse manufactured by S&C Electric Company. The invention is not so limited, however.

With continued reference to FIG. 1, hinge assembly 104 includes, at a lower region 111, an output port 110 through which exhaust gases may be emitted during an overload event. In accordance with one aspect, as described in further detail below, output port 110 is configured to emit the exhaust gases at a non-zero angle θ with respect to longitudinal axis A-A. That is, the exhaust gases exiting output port 110 are effectively directed away from front region 120 during an overload event. In one embodiment, angle θ is in a range of approximately 40 to 50 degrees. In a particular embodiment, angle θ is in a range of approximately 43 and 46 degrees, and preferably approximately 45 degrees.

In accordance with the illustrated embodiment, hinge assembly 104 also includes a lift ring 116 as well as cap component or cap 112 that is rotatably coupled to hinge assembly 104 at a pivot 114. Cap 112, as described in further detail below, is configured (e.g., via its geometry and weight distribution) to engage and close off outlet port 110 when fuse unit 102 is substantially inverted, but to remain open (as shown in FIG. 1) when oriented as shown. Thus, cap 112 functions as a self-opening, balanced "rain cap," protecting the interior of hinge assembly 104 from rain and other such climate conditions when fuse unit 102 is inverted, but otherwise allowing the free flow of exhaust gases from outlet port 110 when fuse unit 102 and hinge assembly 104 in their installed configuration.

FIG. 2 presents another embodiment in which a power fuse assembly 200 includes a silencer component 210 attached at a bottom end (e.g., the outlet port 110 of FIG. 1, not shown in FIG. 2) of hinge assembly 104. In addition, the hinge assembly 104 of FIG. 2 is oriented such that lower region 111 is oriented to some extent toward front region 120 by an angle θ. In one embodiment, angle θ is in a range of approximately 40 to 50 degrees. In a particular embodiment, angle θ is in a range of approximately 43 and 46 degrees, and preferably approximately 45 degrees.

Silencer component 210 may include any suitable structure capable of guiding and emitting the exhaust gases 212 produced during an overload event. In that regard, silencer component 210 will generally include labyrinthine or similar internal structures that lead to (are in fluid communication with) a series of openings (not shown) at the bottom of silencer component 210. Such silencers components are known in the art, and need not be further described in detail herein.

With continued reference to FIG. 2, it will be appreciated that the orientation and configuration of hinge assembly 104 advantageously allow, during maintenance or after an overload event, silencer component 210 to rotate (clockwise in FIG. 2) without silencer component 210 being impeded by lower contact assembly 106. That is, if lower region 111 of hinge assembly 104 were aligned parallel with longitudinal axis A-A, silencer component 210 might collide with assembly 106 and/or other components in the vicinity of assembly 106 when fuse unit 102 is rotated about hinge pivot 108.

Thus, FIGS. 1 and 2 depict two different embodiments utilizing a hinge assembly 104 to deflect and accommodate exhaust gases. In the first, non-silencer embodiment (power fuse assembly 100) shown in FIG. 1, orientation of the hinge assembly 104 deflects exhaust gases away from front region 120. In the second, silencer-based embodiment (power fuse assembly 200) shown in FIG. 2, orientation of the hinge assembly 104 deflects exhaust gases toward front region 120 with the silencer component 210 capturing and controlling the emission of exhaust gases therefrom. In this regard, hinge assembly 104 in either embodiment might be manufactured as single component (e.g., cast metal), or multiple components that can be assembled in multiple configurations to achieve the desired orientation.

Figure 3:
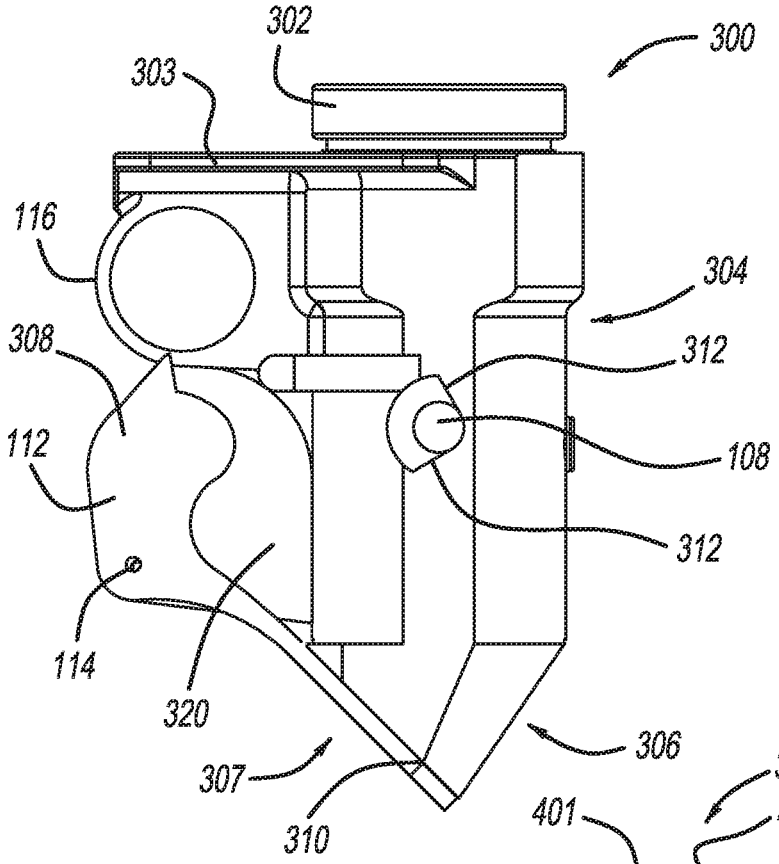
FIG. 3 is a side view of a hinge assembly in accordance with one embodiment.
Figure 4:
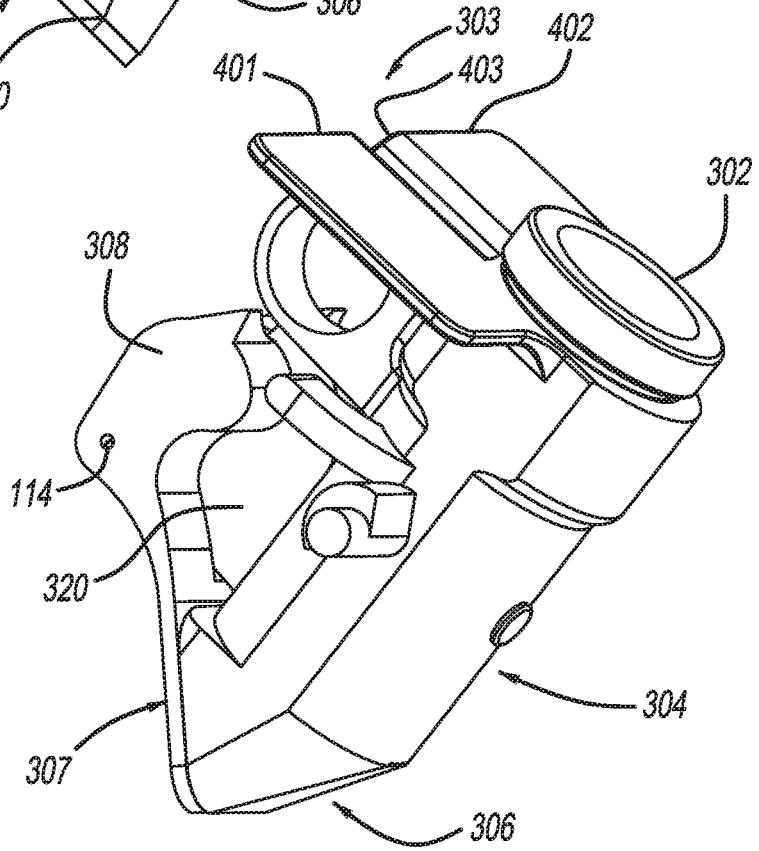
FIG. 4 is an isometric view of the hinge assembly depicted in FIG. 3.

FIGS. 3 and 4 show, in greater detail, an exemplary hinge assembly 304 in accordance with various embodiments. That is, FIG. 3 is a side view, and FIG. 4 is an isometric view of the same or similar hinge assembly 304. Referring to FIG. 3, hinge assembly 304 is shown as having an outward projecting hinge pivot 108 and a cam segment 312 that locks the fuse hinge casting in the mounting hinge to prevent inadvertent movement out of the hinge during rotation of the fuse. Cam segment 312 is configured to lock into the stationary hinge casting to prevent falling out as the fuse is rotated closed.

Figure 5:
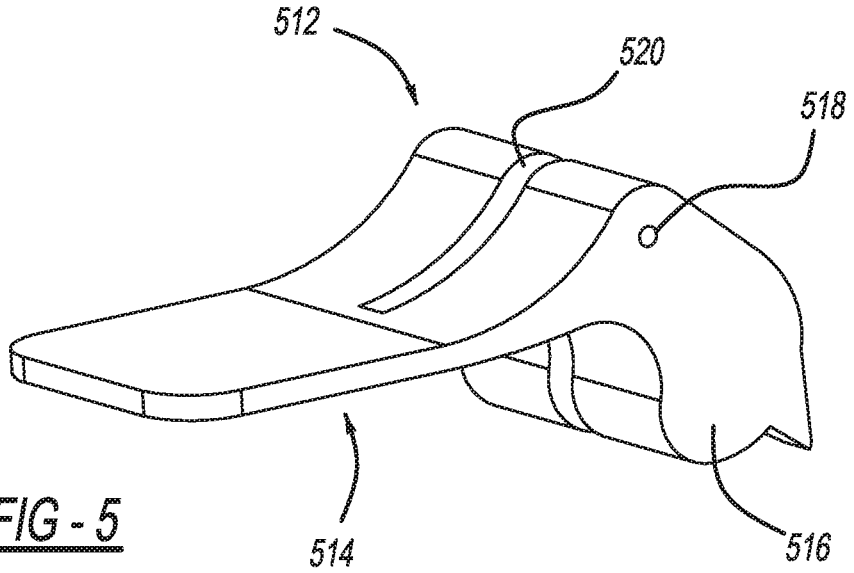
FIG. 5 is an isometric view of a cap component in accordance with one embodiment.

Also shown in FIGS. 3 and 4 is cap 112, which as mentioned above is configured to rotate about a pivot 114 (e.g., a pin, screw, or other such fastening component) with respect to a support structure 320 that is part of or otherwise coupled to hinge assembly 304. Cap 112 is shown in the "closed" state—i.e., it is substantially blocking opening 310 of hinge assembly 304 at bottom region 306. Cap 112 includes a covering portion 307 (which blocks opening 310) and a counterweight portion 308. The shape, position, material, and/or size of counterweight portion 308 is selected such that, when hinge assembly 304 is in the normal operating orientation (such as shown in FIG. 1), the counterweight portion 308 causes the relatively lighter covering portion 307 to rotate and unblock opening 310. Similarly, when hinge assembly 304 is substantially in a partially or entirely inverted state, the counterweight portion 308 causes covering portion 307 to block opening 310, thereby preventing rain and other contaminants from entering hinge assembly 304. In one embodiment, support structure 320 (which is rotatably secured to cap 112 via pivot 114) is a relatively thin structure that fits within a corresponding slot 520 of cap 112. FIG. 5, for example, shows an exemplary cap 512 including a covering portion 514, a counterweight portion 516, and a bore 518 for accepting a pivot component (e.g., 114 of FIG. 3). Also shown in a central slotted portion 520 that is configured to accept support structure 320 of FIG. 3.

With continued reference to FIG. 3, hinge assembly 304 may also include a gland nut 302 to assist in securing the fuse unit 102 of FIG. 1 to hinge assembly 304. Additional components known in the art may be used to secure and orient the fuse unit with respect to hinge assembly 304—for example, one or more alignment pins, an alignment sleeve, or the like.

While opening 310 may be oriented such that escaping gases move at approximately a 45 degree downward angle relative to the orientation of FIG. 3, it has been observed that such exhaust gases may actually flow upward during an overload event. In that regard, FIGS. 3 and 4 further illustrate an embodiment that includes a flat plate structure 303 that is substantially orthogonal to the orientation of the fuse element when it is inserted into hinge assembly 304. As shown in FIG. 4, plate structure 303 includes two opposing side structures 401 and 402 and a central indented region 403. Plate structure 303 further assists in managing exhaust gases by preventing or impeding the vertical (i.e., parallel to longitudinal axis A-A in FIG. 1) movement of gases as they are ejected from opening 310 and deflecting the gases substantially sideways.

Figure 6:
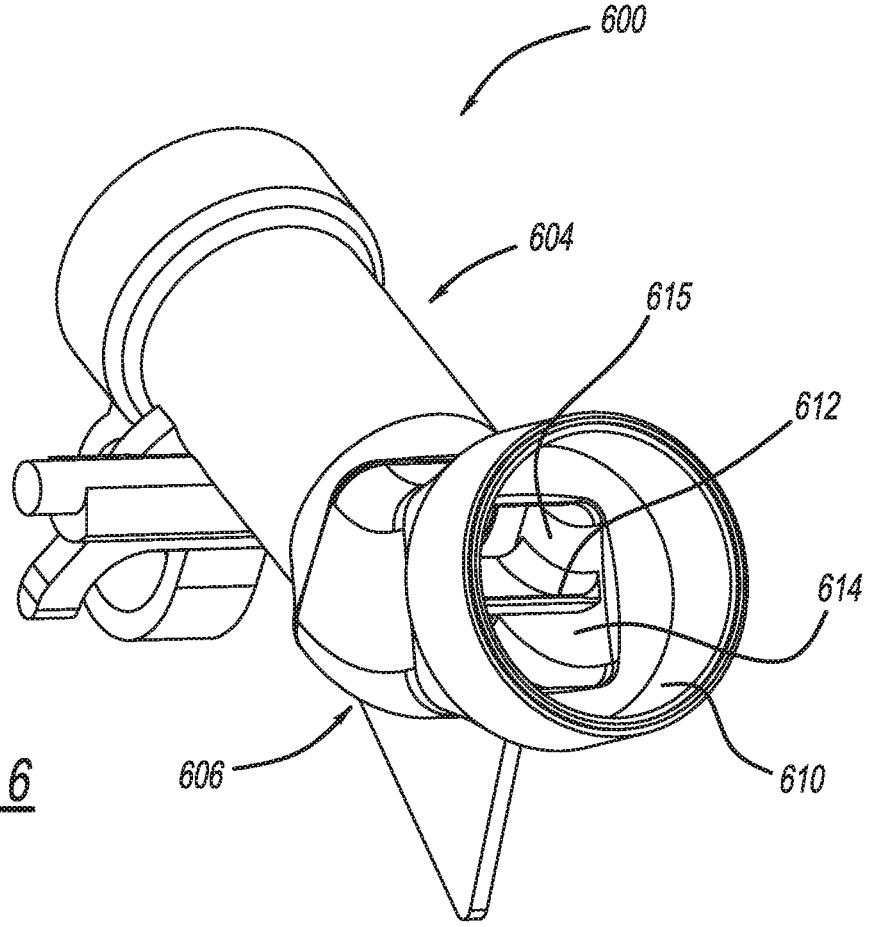
FIG. 6 is an isometric view of a portion of a hinge assembly in accordance with one embodiment.
Figure 7:
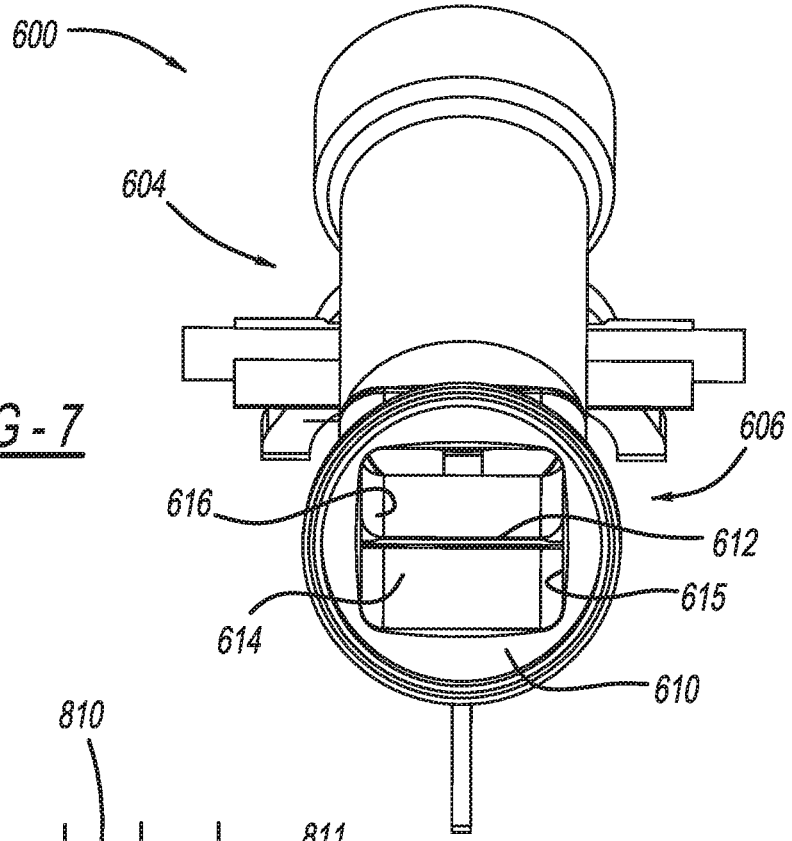
FIG. 7 is an end-on view of the portion of the hinge assembly depicted in FIG. 6.

FIGS. 6 and 7 show the interior of a hinge assembly 600 in accordance with an embodiment. Specifically, referring to FIG. 7, hinge assembly 600 includes an upper portion 604 and lower portion 606. Lower portion 606 includes a generally rectangular inner chamber 614 in which a diverter structure (or simply "diverter") 612 is disposed for diverting the flow of exhaust as it moves from upper portion 604 to opening 610. In the illustrated embodiment, diverter 612 extends between two opposing walls 615 and 616 and is located at approximately the midpoint of inner chamber 614. Diverter 612 is thus oriented approximately horizontally relative to the orientation of hinge assembly 600 as shown in FIG. 7. The range of embodiments is not so limiting, however. Inner chamber 614 may have a variety of shapes, depending upon the application, including cylindrical, curvilinear, polygonal, or the like. Similarly, diverter 612 may be located at any suitable location relative to inner chamber 614 (e.g., above or below its approximate center line). Furthermore, diverter 612 need not extend the full distance between walls 615 and 616, and it need not be one piece or otherwise continuous.

Figure 8:
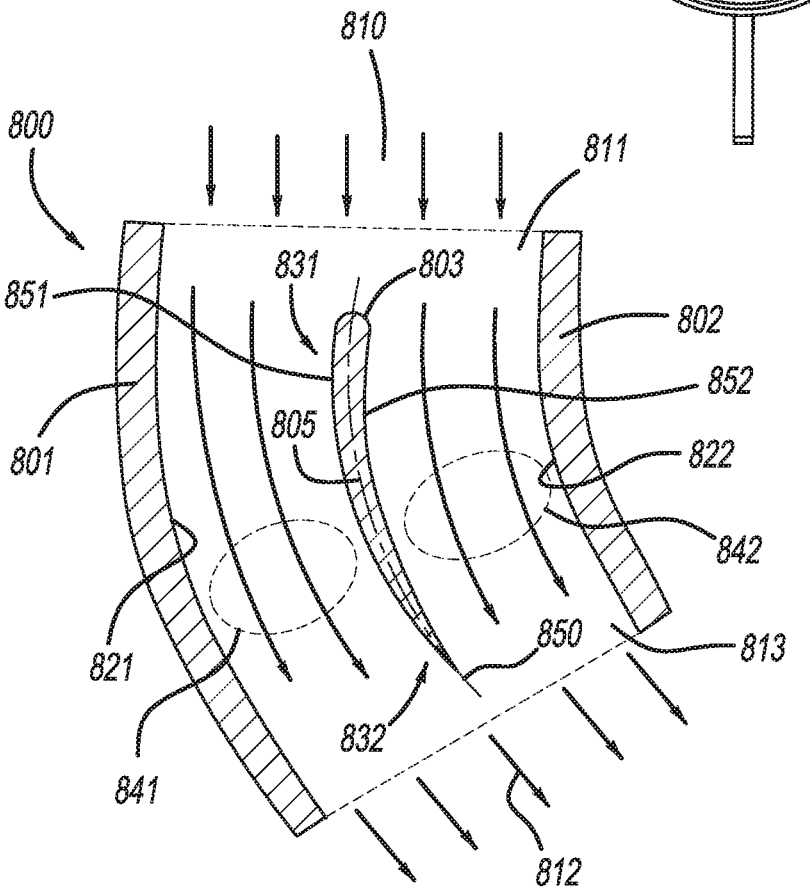
FIG. 8 is a cross-sectional view a hinge assembly depicting the flow of exhaust gases in accordance with one embodiment.

FIG. 8 is a cross-sectional, simplified view that illustrates, conceptually, the function of a diverter vane 805 that may be used to implement the diverter 612 of FIGS. 6 and 7. Specifically, FIG. 8 illustrates a diverter housing or bend portion 800 of an exemplary hinge assembly such as that shown in FIG. 7. Bend portion 800 includes an inlet region (or simply "inlet") 811 for accepting the incoming exhaust gases 810, and an outlet region (or simply "outlet") 813 for emitting the exhaust gases 812. Bend portion 800 includes opposing walls 801 and 802, each having an inner surface 821 and 822, respectively defining a curved conduit through bend portion 800. In FIG. 8, the parallel arrows generally show (conceptually) the direction of exhaust gas flow.

As can be seen, the direction of the incoming exhaust gases 810 is different from the direction of the outgoing exhaust gases 812 by a predetermined angle as discussed above in connection with FIG. 1. Further, the orientation of inlet 811 (i.e., the normal vector of the plane defined by inlet 811) is not equal to the orientation of outlet 813 (i.e., the normal vector of the plane defined by outlet 813).

In general, diverter vane 805 has an upstream portion 831 and a downstream portion 832, as shown. The leading edge 803 of diverter vane 805 effectively splits the incoming exhaust gases into two parallel flows (indicated generally by regions 841 and 842) before those flows are recombined prior to or at the outlet region 813.

Diverter vane 805 may have a variety of shapes. In the illustrated embodiment, diverter vane 805 is illustrated as generally airfoil-shaped; having opposing surfaces 851 and 852, and has a profile that substantially follows the contours of surfaces 821 and 822. That is, to the extent that diverter vane 805 is an airfoil, it has a mean camber line 850 that has substantially the same arcuate shape as one or more of surfaces 821 and 822. In the illustrated embodiment, diverter vane 805 is substantially concave facing surface 822 (adjacent surface 852), and substantially convex facing surface 821 (adjacent surface 851).

Redirecting exhaust gasses 810, 812 employs a pressure gradient produced by a pressure against the flow on one side and a lowered pressure at the other side of the flow. To provide added pressure surfaces and low pressure relief sides, the flow is split into two (or more) flows such that each division of flow has a high and low pressure side prior to rejoining at the final exhaust outlet 813. One divided flow 842 is between surface 852 and surface 822. Surface 852 presses against the flow 842, causing a sideways pressure on the gasses impinging on it while surface 822 retreats from the flow with a turbulent boundary layer causing a lower pressure to that side allowing the gasses to follow the radius of the curve. Similarly, gasses in flow 841 are situated between high pressure caused by surface 821 and a lower pressure following surface 851 of the web. Use of a simple "elbow" shape with no division would in most instanced cause decoupling from the lower pressure surface, resulting in a swirling "eddy" that would reduce the effective area of the port and cause a back-pressure which would reduce the ability of the fuse to interrupt the rated load.

In accordance with another aspect, diverter vane 805 may be used as a "wear indicator." That is, visual inspection of its dimensions (e.g., the thickness of material between surfaces 851 and 852) will generally reveal the expected remaining lifetime of bend portion 800 (and thus the hinge assembly in which it is incorporated). The correlation of observable thickness to expected lifetime may be established in a variety of ways, including computer modeling and/or empirical testing. In addition, the observed condition of walls 801 and 802 may also be used as a gauge of expected lifetime, based on, for example, the extent to which burn-through marks are observed on the inner surfaces 821 and 822.

While FIG. 8 illustrates a single airfoil-shaped diverter 805, it will be appreciated that the range of embodiments is not so limited. For example, diverter vane 805 may include two, three, or even more discrete diverter structures (e.g., substantially parallel structures configured to guide the flow). Diverter vane 805 may also have a variety of shapes and profiles, such as flat, piecewise linear, curvilinear, diamond-shaped, or the like.

Diverter vane 805 may be manufactured using a variety of methods and may be formed from any material or combination of materials configured to withstand the pressure and temperature of the exhaust gases. In some embodiments, diverter vane 805 includes a metal alloy that is cast as an integrated part of the hinge assembly. In other embodiments, diverter vane 805 is a ceramic or composite material.

While at least one exemplary embodiment has been presented in the foregoing detailed description, it should be appreciated that a vast number of variations exist. It should also be appreciated that the exemplary embodiment or exemplary embodiments are only examples, and are not intended to be models or otherwise limit the scope, applicability, or configuration of the disclosure in any way. Rather, the foregoing detailed description will provide those skilled in the art with a convenient road map for implementing the exemplary embodiment or exemplary embodiments. It should be understood that various changes can be made in the function and arrangement of elements without departing from the scope of the disclosure as set forth in the appended claims and the legal equivalents thereof.

What is claimed is:

1. A power fuse assembly comprising:

a fuse mounting;

a fuse unit configured to carry current from a line connection to a load connection;

a hinge assembly removably coupling the fuse unit to the fuse mounting to allow rotation of the fuse unit relative to the fuse mounting, the hinge assembly including:

an inlet configured to accept incoming gases produced by the fuse unit in response to an overload event, the inlet having a first orientation;

an outlet in fluid communication with the inlet, the outlet having a second orientation that is not equal to the first orientation; and a diverter component disposed within the hinge assembly between the inlet and the outlet, the diverter component having an airfoil configuration configured to guide the flow of the gases from the inlet in the first orientation to the outlet in the second orientation.

2. The power fuse assembly of claim 1, wherein the fuse unit has a longitudinal axis, the orientation of the outlet has a predetermined angle in a range between 40 and 50 degrees with respect to the longitudinal axis.

3. The power fuse assembly of claim 2, wherein the orientation of the outlet faces away from a front region of the power fuse assembly.

4. The power fuse assembly of claim 1, wherein the hinge assembly comprises a curved inner chamber between the inlet and the outlet, and the airfoil configuration of the diverter component comprises an airfoil-shaped component having a curved shape substantially the same as the curved inner chamber and extending between a first wall of the curved inner chamber and an opposite second wall of the curved inner chamber.

5. A hinge assembly configured to removably couple a fuse unit to a power fuse assembly, the hinge assembly comprising:

an inlet configured to accept incoming gases produced by the fuse unit in response to an overload event, the inlet having a first orientation;

an outlet in fluid communication with the inlet, the outlet having a second orientation that is not equal to the first orientation; and a diverter component disposed within the hinge assembly between the inlet and the outlet, the diverter component including a curved inner chamber and a curved diverter vane having an airfoil configuration that divides the curved inner chamber into parallel exhaust gas passageways, wherein the curved inner chamber and the curved diverter vane are configured to guide the flow of the gases from the inlet in the first orientation to the outlet in the second orientation.

6. The hinge assembly of claim 5, wherein the orientation of the outlet has a predetermined angle with respect to a longitudinal axis of the fuse unit of between approximately 40 and 50 degrees.

7. The hinge assembly of claim 5, wherein the orientation of the outlet faces away from a front region of the fuse mounting.

8. A power fuse assembly comprising:

a mount having an upper contact assembly, a lower contact assembly and an insulator body extending therebetween;

a fuse tube defining a longitudinal axis and having first and second ends;

a fitting disposed on the first end of the fuse tube and releasably retained in the upper contact assembly of the mount;

a hinge assembly disposed on the second end of the fuse tube and pivotally coupled to the lower contact assembly to allow rotation of the fuse tube relative to the mount, wherein the fuse tube is positionable between a first position with the fitting retained in the upper contact assembly for closing a current path from a line connection to a load connection and a second position with the fitting released from the upper contact assembly for opening the current path; and a diverter housing extending from the hinge assembly, the diverter housing having an inlet arranged in a first orientation in fluid communication with the fuse tube, an outlet arranged in a second orientation that is different than the first orientation, an inner chamber having a curved conduit between the inlet and the outlet, and a curved diverter vane having an airfoil configuration disposed in the curved conduit for dividing the inner chamber into parallel exhaust gas passageways, wherein the curved conduit and the curved diverter vane are configured to direct the flow of the gases from the inlet to the outlet.

* * * * *